US010012080B2

(12) United States Patent
Ma et al.

(10) Patent No.: US 10,012,080 B2
(45) Date of Patent: Jul. 3, 2018

(54) SKIP-MINING TYPE WANGEVIRY STOPE BRANCH ROADWAY FILLING AND COAL MINING METHOD

(71) Applicant: China University of Mining and Technology, Xuzhou (CN)

(72) Inventors: Liqiang Ma, Xuzhou (CN); Xiaomin Yu, Xuzhou (CN); Yinzhong Zhang, Xuzhou (CN); Jiaxue Wang, Xuzhou (CN); Junjie Wang, Xuzhou (CN); Maoping Zhao, Xuzhou (CN); Jianbo Cao, Xuzhou (CN); Peng Dl, Xuzhou (CN); Zhiyuan Jin, Xuzhou (CN); Fei Wang, Xuzhou (CN)

(73) Assignee: China University of Mining and Technology, Jiangsu (CN)

( * ) Notice: Subject to any disclaimer, the term of this patent is extended or adjusted under 35 U.S.C. 154(b) by 71 days.

(21) Appl. No.: 15/038,511

(22) PCT Filed: Nov. 19, 2014

(86) PCT No.: PCT/CN2014/091493
§ 371 (c)(1),
(2) Date: May 23, 2016

(87) PCT Pub. No.: WO2015/090128
PCT Pub. Date: Jun. 25, 2015

(65) Prior Publication Data

US 2016/0305245 A1 Oct. 20, 2016

(30) Foreign Application Priority Data

Dec. 18, 2013 (CN) ..... 2013 1 0700464

(51) Int. Cl.
*E21F 15/00* (2006.01)
*E21C 41/16* (2006.01)
*E21C 41/18* (2006.01)

(52) U.S. Cl.
CPC ..... *E21F 15/00* (2013.01); *E21C 41/16* (2013.01); *E21C 41/18* (2013.01)

(58) Field of Classification Search
CPC ..... E21F 15/00; E21C 41/16; E21C 41/18
(Continued)

(56) References Cited

U.S. PATENT DOCUMENTS 3,455,606 A 7/1969 Fischer et al.
3,999,804 A * 12/1976 Simpson ..... E21C 41/18 299/11
(Continued)

FOREIGN PATENT DOCUMENTS

CN 1410655 A 4/2003
CN 1737335 A 2/2006
(Continued)

OTHER PUBLICATIONS

International Search Report re PCT/CN2014/091493, dated Feb. 15, 2015, 4 pgs.

*Primary Examiner* — Carib A Oquendo
(74) *Attorney, Agent, or Firm* — Greenberg Traurig, LLP

(57) ABSTRACT

A transportation main roadway and stope branch roadways are arranged by adopting a wangeviry coal mining method. A plurality of stope branch roadways are divided into multiple mining stages, based on which the stope branch roadways are skip-mined; and coal pillars are not reserved among the stope branch roadways. The transportation main roadway is a main transportation channel, and the stope branch roadways are coal mining roadways. All the stope branch roadways are sequentially stoped in a skip-mining
(Continued)

manner according to the designed mining sequence and are sequentially and timely filled. The coal never stoped or the filled stope branch roadways is/are used as supports for controlling roofs at the two sides of the stope branch roadways, and the stope branch roadways are sequentially stoped according to a plurality of mining stages, and finally the coal pillar-free mining is realized.

2 Claims, 3 Drawing Sheets

(58) Field of Classification Search
USPC ..... 299/11, 12, 19
See application file for complete search history.

(56) References Cited

U.S. PATENT DOCUMENTS

| | | | | |
|---|---|---|---|---|
| 4,030,752 | A * | 6/1977 | Simpson | E21C 41/18 299/11 |
| 4,268,088 | A * | 5/1981 | Price | E21C 41/24 299/11 |
| 5,871,260 | A * | 2/1999 | Delli-Gatti, Jr. | E21C 27/24 299/19 |
| 2007/0046094 | A1* | 3/2007 | Gross | E21C 41/16 299/10 |
| 2007/0170771 | A1* | 7/2007 | Cavinder | E21C 41/16 299/19 |
| 2017/0248017 | A1* | 8/2017 | MacDonald | E21C 41/18 |

FOREIGN PATENT DOCUMENTS

| | | | |
|---|---|---|---|
| CN | 102587914 | A | 7/2012 |
| CN | 103696771 | A | 4/2014 |

* cited by examiner

SKIP-MINING TYPE WANGEVIRY STOPE BRANCH ROADWAY FILLING AND COAL MINING METHOD

CROSS REFERENCE TO RELATED APPLICATION

The present application is a 371 U.S. National Stage of International Application No. PCT/CN2014/091493, filed Nov. 19, 2014, which claims the benefit of the earlier filing date of Chinese Patent Application No. 201310700464.9 filed on Dec. 18, 2013, which are each incorporated herein by reference in their entirety.

TECHNICAL FIELD

The present invention relates to a skip-mining type wangeviry stope branch roadway filling and coal mining method, and belongs to the technical field of coal mining.

BACKGROUND ART

There are a huge amount of pressed coals under buildings, railroads, and water-bodies in China, which are added up to 13.79 billion tons, according to the incomplete statistics made by major state-owned coal mines in China.

As the technical level of coal mining is improved, techniques for mining pressed coal under buildings, railroads, and water-bodies have been developed greatly. Presently, commonly used surface subsidence controlling methods mainly include: coordinated mining, partial mining, grouting into separated strata in overburden, and mining with filling, etc. Coordinated mining utilizes the counter balancing among surface deformations resulted from simultaneous mining at multiple working faces to attain the purpose of reducing surface deformation, but it involves simultaneous mining at multiple working faces, and is constrained by the layout of protected objects on the ground surface; therefore, it has great impacts on the pioneering design and has limited applicability. Partial mining controls overlying strata movement and surface subsidence by mining coal partially and reserving permanent coal pillars in certain width, and mainly includes wangeviry mining, room and pillar mining, strip mining, limited thickness mining, knife mining, and roadway mining, etc. Though these methods can control surface subsidence to certain degree, their recovery ratios are not high, usually about 50%. Grouting into separated strata in overburden utilizes bore grouting to fill the space of separated strata between upper hard formation and lower soft formation, to attain the purpose of controlling the overlying bed subsidence above the hard formation and the surface subsidence; with that method, the surface subsidence reduction ratio is usually not higher than 40%. Compared with other surface subsidence controlling methods, mining with filling is the most effective method for controlling surface subsidence at present, and the goaf can be filled partially or fully. Depending on the layout of working face, the main method can be goaf filling along long-wall working face, strip filling, or roadway filling, etc. The problems existing in these methods mainly include: difficulties in coordination between coal mining and filling, complex filling system, large filling space, and long filling time, etc.

SUMMARY

Technical Problem

To overcome the drawbacks in the prior art, the present invention provides a skip-mining type wangeviry stope branch roadway filling and coal mining method, which is reasonable, requires a simple system, supports synchronous and coordinated operation of coal mining and filling, can attain a high coal recovery ratio and a good surface subsidence control effect, and is safe and efficient.

Technical Scheme

The skip-mining type wangeviry stope branch roadway filling and coal mining method provided in the present invention comprises the following steps:

From a centralized transportation roadway towards an air return roadway, tunneling an inclined transportation main roadway in communication with the air return roadway, at the terminal of a working face, wherein the exit of the transportation main roadway in communication with the air return roadway is disposed in the middle of the working face.

Dividing the coal bodies at the left and right sides of the transportation main roadway into multiple stope branch roadways opposite orthogonally by strip mining, according to the geological conditions of the surrounding rocks of the mining area.

Allocating multiple stope branch roadways opposite orthogonally into multiple mining stages, and mining the first stope branch roadway allocated in the first mining stage, i.e., mining from the transportation main roadway at one side of the air return roadway towards the first transverse stope branch roadway on the left, and then filling the transverse stope branch roadway immediately after mining, and then, mining from the transportation main roadway towards the first longitudinal stope branch roadway on the right, and filling the longitudinal stope branch roadway immediately after mining.

Mining the first stope branch roadway in the next mining stage sequentially, i.e., mining from the transportation main roadway towards the first transverse stope branch roadway in the next mining stage on the left, and then filling the transverse stope branch roadway immediately after mining, and then, mining from the transportation main roadway towards the first longitudinal stope branch roadway in the next mining stage on the right, and then filling the stope branch roadway immediately after mining, till the first stope branch roadways allocated in all mining stages are mined and filled.

Mining the second stope branch roadway in the first mining stage, i.e., mining from the transportation main roadway towards the second transverse stope branch roadway in the first mining stage on the left, and then filling the transverse stope branch roadway immediately after mining, and then, mining from the transportation main roadway towards the second longitudinal stope branch roadway in the first mining stage on the right, and then filling the longitudinal stope branch roadway immediately after mining.

Mining the second stope branch roadway in the next mining stage sequentially, i.e., mining from the transportation main roadway towards the second transverse stope branch roadway in the next mining stage on the left, and then filling the transverse stope branch roadway immediately after mining, and then, mining from the transportation main roadway towards the second longitudinal stope branch roadway in the next mining stage on the right, and then filling the stope branch roadway immediately after mining, till the second stope branch roadways allocated in all mining stages are mined and filled.

Back and forth, mining the next stope branch roadway in the next mining stage sequentially, i.e., mining from the transportation main roadway towards the next transverse stope branch roadway in the next mining stage on the left, and then filling the transverse stope branch roadway immediately after mining, and then, mining from the transportation main roadway towards the next longitudinal stope branch roadway in the next mining stage on the right, and then filling the stope branch roadway immediately after mining, till all stope branch roadways allocated in all mining stages are mined and filled.

Filling the transportation main roadway after all stope branch roadways allocated in the all mining stages are mined and filled.

The transportation main roadway has a width of 5~6 m. the stope branch roadways has a width of ≥3.3 m and a length of 5~150 m.

Benefits:

In the present invention, a transportation main roadway and multiple stope branch roadways are arranged with a wangeviry mining method, and the stope branch roadways are allocated into multiple mining stages and are skip-mined according to the allocated mining stages, without coal pillar reserved among the stope branch roadways. The transportation main roadway is the main transportation channel, while the stope branch roadways are coal mining roadways. The stope branch roadways are stoped by skip-mining in stages sequentially according to the designed mining sequence and are filled timely. Several stope branch roadways are reserved among stope branch roadways which are stoped in the same stage, and the stope branch roadways that have not been stoped and the stope branch roadways that have been filled are utilized as supports to support the roof. After the filling bodies meet the strength requirement, the stope branch roadways reserved in the coal pillars that have not been stoped are stoped and filled sequentially in the same way, so that the coals are replaced by the filling bodies. The skip-mining type wangeviry stope branch roadway filling and coal mining method takes full advantages of wangeviry coal mining method and mining with filling method, overcomes the drawbacks in the conventional coal mining methods for mining coal under buildings, roadways, and waterbodies, such as low coal recovery ratio, difficult coordinative operation between mining and filling, and complex production system, etc., can realize safe and efficient stopping of pressed coal under buildings, railways and water bodies and effectively controlling of ground surface subsidence. In addition, the skip-mining type wangeviry stope branch roadway filling and coal mining method is capable of realizing water preserving coal mining. The method provided in the present invention is suitable for stoping in regular working face as well as stoping in irregular working face, and recovery of coal pillars and boundary coal. The method is simple, easy to implement, can attain a good effect, and has high practicability.

Figure 1:
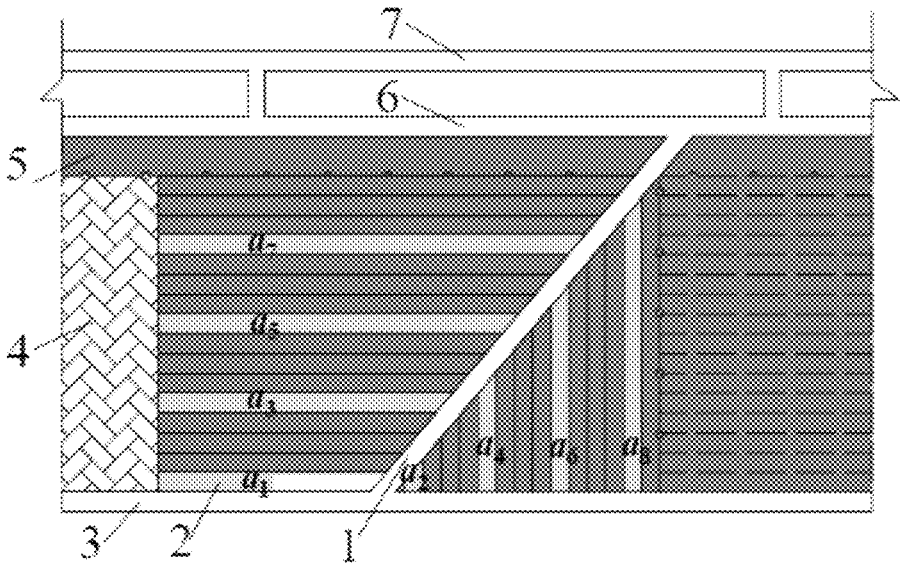
FIG. 1 is a schematic diagram of the mining and filling sequence for the first stope branch roadways allocated in all mining stages in the present invention.

Among the figures: 1—transportation main roadway, 2—stope branch roadway, 3—air return roadway, 4—filled wall, 5—protective coal pillar, 6—centralized transportation roadway, 7—rail roadway, 8—filled stope branch roadway

DETAILED DESCRIPTION

Hereunder the present invention will be described in details with reference to the accompanying drawings.

The skip-mining type wangeviry stope branch roadway filling and coal mining method provided in the present invention includes the following steps.

At the terminal of a coal mining working face, from a centralized transportation roadway 6 towards an air return roadway 3, tunnel an inclined transportation main roadway 1 in communication with the air return roadway 3, with the exit of the transportation main roadway 1 in communication with the air return roadway 3 being disposed in the middle of the coal mining working face. The transportation main roadway 1 has a width of 5 m~6 m. The stope branch roadway 2 has a width of ≥3.3 m and a length of 5 m~150 m. the equipment required for the working face is transported through a rail roadway 7.

Dividing the coal bodies at the left and right sides of the transportation main roadway 1 into multiple stope branch roadways 2 opposite orthogonally by strip mining, according to the geological condition of the surrounding rocks of the mining area.

Allocating multiple stope branch roadways 2 opposite orthogonally into multiple mining stages, and mining the first stope branch roadway 2 allocated in the first mining stage first, i.e., mining from the transportation main roadway 1 at one side of the air return roadway 3 towards the first transverse stope branch roadway $a_1$ on the left, and then filling the transverse stope branch roadway $a_1$ immediately after mining, next, mining from the transportation main roadway 1 towards the first longitudinal stope branch roadway $a_2$ on the right, and then filling the longitudinal stope branch roadway $a_2$ immediately after mining.

Mining the first stope branch roadway 2 in the next mining stage sequentially, i.e., mining from the transportation main roadway 1 towards the first transverse stope branch roadway $a_3$ in the next mining stage on the left, and then filling the transverse stope branch roadway immediately after the mining, next, stoping from the transportation main roadway towards the first longitudinal stope branch roadway $a_4$ in the next mining stage on the right, and then filling the stope branch roadway immediately after the mining. Repeating in that way, until the first stope branch roadways $a_i$ allocated in all mining stages are mined and filled.

Mining the second stope branch roadway 2 in the first mining stage, i.e., mining from the transportation main roadway 1 towards the second transverse stope branch roadway $b_1$ in the first mining stage on the left, adjacent to the filled stope branch roadway, and then filling the transverse stope branch roadway $b_1$ immediately after the stoping, next, mining from the transportation main roadway 1 towards the second longitudinal stope branch roadway $b_2$ in the first mining stage on the right, adjacent to the filled stope branch roadway 8, and then filling the stope branch roadway $b_2$ immediately after the mining.

Mining the second stope branch roadway 2 in the next mining stage sequentially, adjacent to the filled stope branch roadway 8, i.e., mining from the transportation main roadway 1 towards the second transverse stope branch roadway $b_3$ in the next mining stage on the left, and then filling the transverse stope branch roadway $b_3$ immediately after the mining, next, mining from the transportation main roadway towards the second longitudinal stope branch roadway $b_4$ in the next mining stage on the right, and then filling the stope branch roadway $b_4$ immediately after the mining, till the second stope branch roadways $b_i$ allocated in all mining stages are mined and filled.

Back and forth, mining the next stope branch roadway 2 in the next mining stage sequentially, adjacent to the filled stope branch roadway 8, i.e., mining from the transportation main roadway 1 towards the next transverse stope branch roadway 2 in the next mining stage on the left, and then filling the transverse stope branch roadway 2 immediately after the mining, next, mining from the transportation main roadway 1 towards the next longitudinal stope branch roadway 2 in the next mining stage on the right, and then filling the stope branch roadway 2 immediately after the mining, till all stope branch roadways 2 allocated in all mining stages are mined and filled. Finally, only protective coal pillars 5 in the centralized transportation roadway 6 are left, and the entire working face is completely filled and supported by filled walls 4. thus, pillar-free coal mining is realized.

As shown in FIG. 1, in a case that multiple stope branch roadways 2 opposite orthogonally are allocated into four mining stages, the steps are as follows:

At the terminal of a coal mining working face, from a centralized transportation roadway 6 towards an air return roadway 3, tunnel an inclined transportation main roadway 1 in communication with the air return roadway 3, with the exit of the transportation main roadway 1 in communication with the air return roadway 3 being disposed in the middle of the coal mining working face. the transportation main roadway 1 has a width of 5 m~6 m. The stope branch roadway 2 has a width of ≥3.3 m and a length of 5 m~150 m. the equipment required for the working face is transported through a rail roadway 7.

Divide the coal bodies at the left and right sides of the transportation main roadway 1 into multiple stope branch roadway 2 opposite orthogonally by strip mining.

Allocating multiple stope branch roadways 2 opposite orthogonally into four mining stages, and mining the first stope branch roadway 2 allocated in the first mining stage first, i.e., mining from the transportation main roadway 1 at one side of the air return roadway 3 towards the first transverse stope branch roadway $a_1$ on the left, and then filling the transverse stope branch roadway $a_1$ immediately after the mining, next, mining from the transportation main roadway 1 towards the first longitudinal stope branch roadway $a_2$ on the right, and then filling the longitudinal stope branch roadway $a_2$ immediately after the mining.

Mining the first stope branch roadway 2 in the second mining stage, i.e., mining from the transportation main roadway 1 towards the first transverse stope branch roadway $a_3$ in the second mining stage on the left, and then filling the transverse stope branch roadway $a_3$ immediately after the mining, next, mining from the transportation main roadway towards the first longitudinal stope branch roadway $a_4$ in the second mining stage on the right, and then filling the longitudinal stope branch roadway $a_4$ immediately after the mining.

Mining the first stope branch roadway 2 in the third mining stage, i.e., mining from the transportation main roadway 1 towards the first transverse stope branch roadway $a_5$ in the third mining stage on the left, and then filling the transverse stope branch roadway $a_5$ immediately after the mining, next, mining from the transportation main roadway towards the first longitudinal stope branch roadway $a_6$ in the third mining stage on the right, and then filling the longitudinal stope branch roadway $a_6$ immediately after the mining.

Mining the first stope branch roadway 2 in the fourth mining stage, i.e., mining from the transportation main roadway 1 towards the first transverse stope branch roadway $a_7$ in the fourth mining stage on the left, and then filling the transverse stope branch roadway $a_7$ immediately after the mining, next, mining from the transportation main roadway towards the first longitudinal stope branch roadway $a_8$ in the fourth mining stage on the right, and then filling the longitudinal stope branch roadway $a_8$ immediately after the mining.

Now, the first stope branch roadways 2 in all mining stages have been mined and filled, and the mining sequence of the first stope branch roadways in all mining stages is shown in FIG. 1.

Mining the second stope branch roadway 2 in the first mining stage, i.e., mining from the transportation main roadway 1 towards the second transverse stope branch roadway $b_1$ in the first mining stage on the left, and then filling the transverse stope branch roadway $b_1$ immediately after the mining, next, mining from the transportation main roadway 1 towards the second longitudinal stope branch roadway $b_2$ in the first mining stage on the right, and then filling the longitudinal stope branch roadway $b_2$ immediately after the mining.

Mining the second stope branch roadway 2 in the second mining stage, i.e., mining from the transportation main roadway 1 towards the second transverse stope branch roadway $b_3$ in the second mining stage on the left, and then filling the transverse stope branch roadway $b_3$ immediately after the mining, next, mining from the transportation main roadway towards the second longitudinal stope branch roadway $b_4$ in the second mining stage on the right, and then filling the longitudinal stope branch roadway $b_4$ immediately after the mining.

Mining the second stope branch roadway 2 in the third mining stage, i.e., mining from the transportation main roadway 1 towards the second transverse stope branch roadway $b_5$ in the third mining stage on the left, and then filling the transverse stope branch roadway $b_5$ immediately after the mining, next, mining from the transportation main roadway towards the second longitudinal stope branch roadway $b_6$ in the third mining stage on the right, and then filling the longitudinal stope branch roadway $b_6$ immediately after the mining.

Mining the second stope branch roadway 2 in the fourth mining stage, i.e., mining from the transportation main roadway 1 towards the second transverse stope branch roadway $b_7$ in the fourth mining stage on the left, and then filling the transverse stope branch roadway $b_7$ immediately after the mining, next, mining from the transportation main roadway towards the second longitudinal stope branch roadway $b_8$ in the fourth mining stage on the right, and then filling the longitudinal stope branch roadway $b_8$ immediately after the mining.

Figure 2:
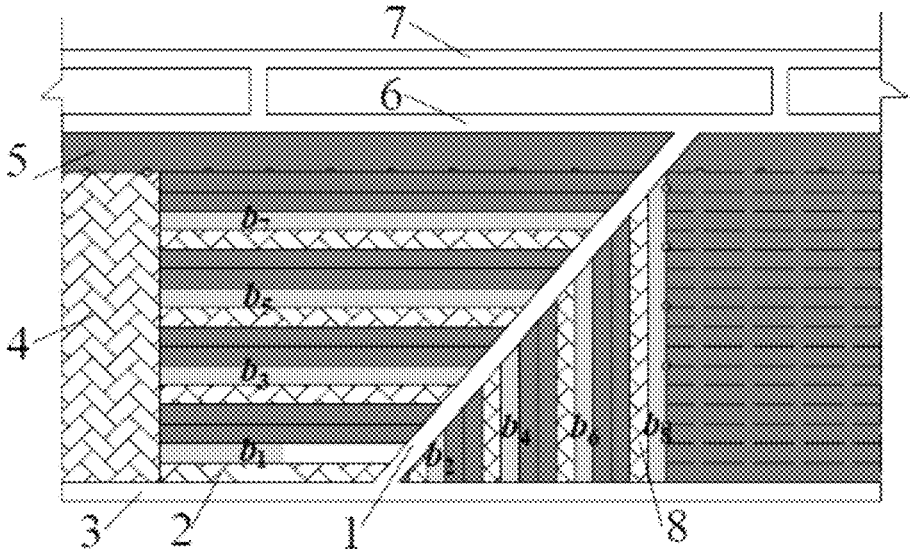
FIG. 2 is a schematic diagram of the mining and filling sequence for the second stope branch roadways allocated in all mining stages in the present invention.

Now, the second stope branch roadways 2 in all mining stages have been mined and filled, and the mining sequence of the second stope branch roadways in all mining stages is shown in FIG. 2.

Mining the third stope branch roadway 2 in the first mining stage, i.e., mining from the transportation main roadway 1 towards the third transverse stope branch roadway $c_1$ in the first mining stage on the left, and then filling the transverse stope branch roadway $c_1$ immediately after the mining, next, mining from the transportation main roadway 1 towards the third longitudinal stope branch roadway $c_2$ in the first mining stage on the right, and then filling the longitudinal stope branch roadway $c_2$ immediately after the mining.

Mining the third stope branch roadway 2 in the second mining stage, i.e., mining from the transportation main roadway 1 towards the third transverse stope branch roadway $c_3$ in the second mining stage on the left, and then filling the transverse stope branch roadway $c_3$ immediately after the mining, next, mining from the transportation main roadway towards the third longitudinal stope branch roadway $c_4$ in the second mining stage on the right, and then filling the longitudinal stope branch roadway $c_4$ immediately after the mining.

Mining the third stope branch roadway 2 in the third mining stage, i.e., mining from the transportation main roadway 1 towards the third transverse stope branch roadway $c_5$ in the third mining stage on the left, and then filling the transverse stope branch roadway $c_5$ immediately after the mining, next, mining from the transportation main roadway towards the third longitudinal stope branch roadway $c_6$ in the third mining stage on the right, and then filling the longitudinal stope branch roadway $c_6$ immediately after the mining.

Mining the third stope branch roadway 2 in the fourth mining stage, i.e., mining from the transportation main roadway 1 towards the third transverse stope branch roadway $c_7$ in the fourth mining stage on the left, and then filling the transverse stope branch roadway $c_7$ immediately after the mining.

Figure 3:
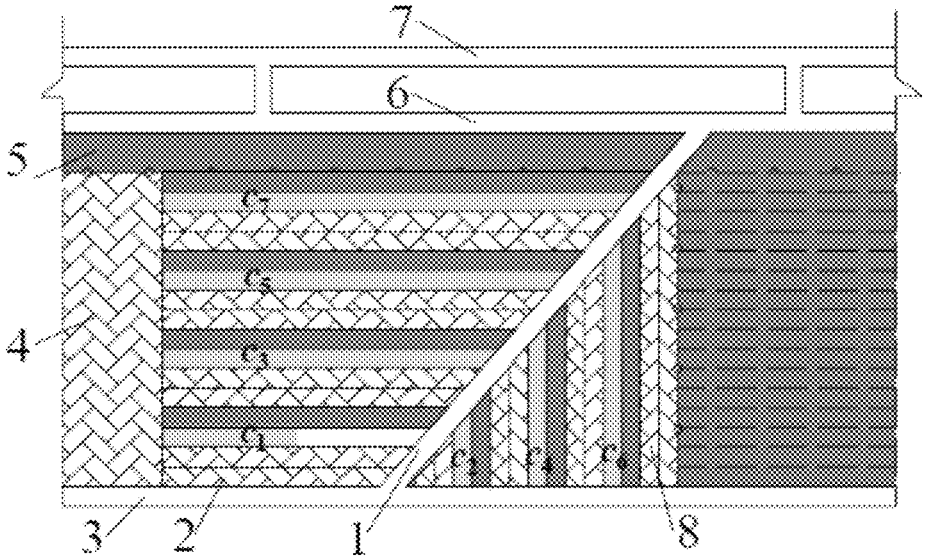
FIG. 3 is a schematic diagram of the mining and filling sequence for the third stope branch roadways allocated in all mining stages in the present invention.

Now, the third stope branch roadways 2 in all mining stages haven been mined and filled, and the mining sequence of the third stope branch roadways in all mining stages is shown in FIG. 3.

Mining the fourth stope branch roadway 2 in the first mining stage, i.e., mining from the transportation main roadway 1 towards the fourth transverse stope branch roadway $d_1$ in the first mining stage on the left, and then filling the transverse stope branch roadway $d_1$ immediately after the mining, next, mining from the transportation main roadway 1 towards the fourth longitudinal stope branch roadway $d_2$ in the first mining stage on the right, and then filling the longitudinal stope branch roadway $d_2$ immediately after the mining.

Mining the fourth stope branch roadway 2 in the second mining stage, i.e., mining from the transportation main roadway 1 towards the fourth transverse stope branch roadway $d_3$ in the second mining stage on the left, and then filling the transverse stope branch roadway $d_3$ immediately after the mining, next, mining from the transportation main roadway towards the fourth longitudinal stope branch roadway $d_4$ in the second mining stage on the right, and then filling the longitudinal stope branch roadway $d_4$ immediately after the mining.

Mining the fourth stope branch roadway 2 in the third mining stage, i.e., mining from the transportation main roadway 1 towards the fourth transverse stope branch roadway $d_5$ in the third mining stage on the left, and then filling the transverse stope branch roadway $d_5$ immediately after the mining, next, mining from the transportation main roadway towards the fourth longitudinal stope branch roadway $d_6$ in the third mining stage on the right, and then filling the longitudinal stope branch roadway $d_6$ immediately after the mining.

Mining the fourth stope branch roadway 2 in the fourth mining stage, i.e., mining from the transportation main roadway 1 towards the fourth transverse stope branch roadway $d_7$ in the fourth mining stage on the left, and then filling the transverse stope branch roadway $d_7$ immediately after the mining.

Figure 4:
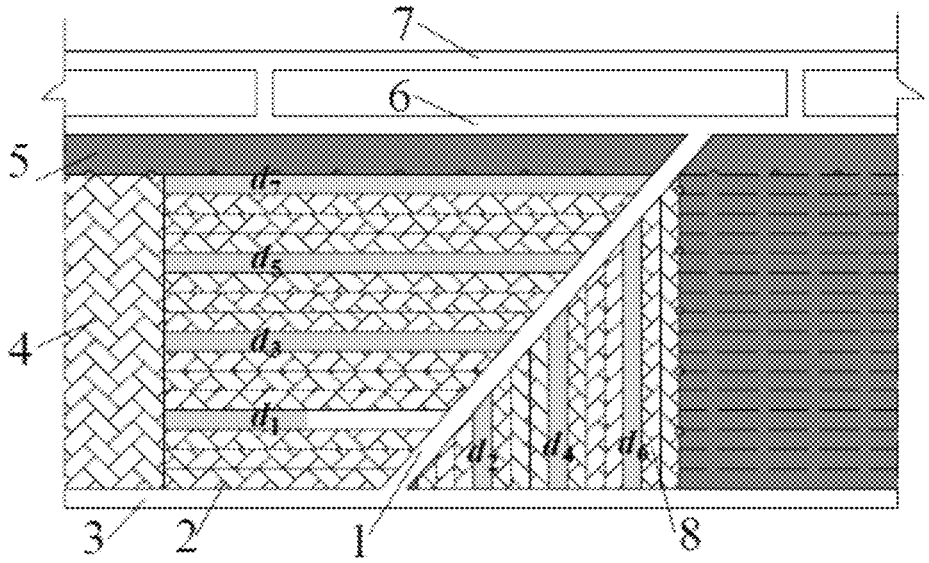
FIG. 4 is a schematic diagram of the mining and filling sequence for the fourth stope branch roadways allocated in all mining stages in the present invention.

Now, the fourth stope branch roadways 2 in all mining stages have been mined and filled, and the mining sequence of the fourth stope branch roadways in all mining stages is shown in FIG. 4.

Figure 5:
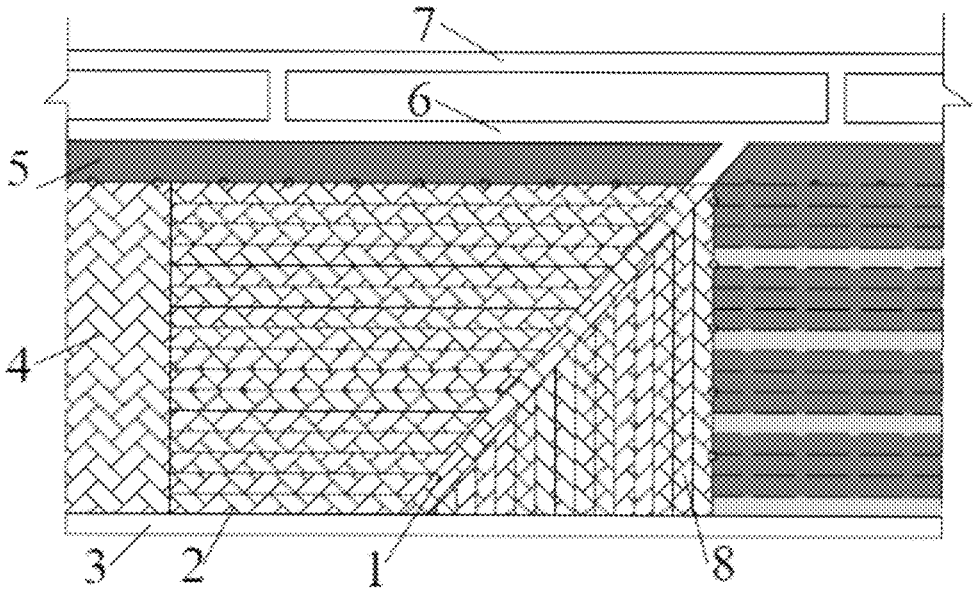
FIG. 5 is a schematic diagram illustrating the situation after all stope branch roadways allocated in all mining stages are mined and filled in the present invention.

Filling the transportation main roadway 1 after all stope branch roadways allocated in all mining stages have been mined and filled, thus, the entire working face is completely filled and supported by filled walls 4, as shown in FIG. 5.

We claim:

1. A skip-mining type wangeviry stope branch roadway filling and coal mining method, comprising the following steps:

a. at a terminal of a coal mining working face, from a centralized transportation roadway towards an air return roadway, tunneling an inclined transportation main roadway in communication with the air return roadway, with an exit of the transportation main roadway in communication with the air return roadway being disposed in the middle of the coal mining working face;

b. dividing a plurality of coal bodies at the left and right sides of the transportation main roadway into multiple stope branch roadways opposite orthogonally by strip mining, according to a geological condition of a surrounding rock of a mining area;

c. allocating the multiple stope branch roadways opposite orthogonally into multiple mining stages, and mining a first one of the multiple stope branch roadways allocated in a first mining stage at first, comprising mining from the transportation main roadway at one side of the air return roadway towards a first transverse stope branch roadway on the left, and then filling the first transverse stope branch roadway immediately after the mining, next, mining from the transportation main roadway towards a first longitudinal stope branch roadway on the right, and then filling the first longitudinal stope branch roadway immediately after the mining;

d. mining each of the first stope branch roadways in a next mining stage sequentially, comprising mining from the transportation main roadway towards the first transverse stope branch roadway in the next mining stage on the left, and then filling the first transverse stope branch roadway immediately after the mining; next, mining from the transportation main roadway towards the first longitudinal stope branch roadway in the next mining stage on the right, and then filling the first longitudinal stope branch roadway immediately after the mining, until the each of the first stope branch roadways allocated in all mining stages are mined and filled;

e. mining a second stope branch roadway in the first mining stage, comprising mining from the transportation main roadway towards a second transverse stope branch roadway in the first mining stage on the left, and then filling the second transverse stope branch roadway immediately after the mining, next, mining from the transportation main roadway towards a second longitudinal stope branch roadway in the first mining stage on the right, and then filling the second longitudinal stope branch roadway immediately after the mining;

f. mining the second stope branch roadway in the next mining stage sequentially, comprising mining from the transportation main roadway towards the second transverse stope branch roadway in the next mining stage on the left, and then filling the second transverse stope branch roadway immediately after the mining, next, mining from the transportation main roadway towards the second longitudinal stope branch roadway in the next mining stage on the right, and then filling the second longitudinal stope branch roadway immediately after the mining, until the second stope branch roadways in all mining stages are mined and filled;

g. repeatedly, mining a next stope branch roadway in the next mining stage sequentially, comprising mining from the transportation main roadway towards a next transverse stope branch roadway in the next mining stage on the left, and then filling the next transverse stope branch roadway immediately after the mining; next, mining from the transportation main roadway towards a next longitudinal stope branch roadway in the next mining stage on the right, and then filling the next longitudinal stope branch roadway immediately after the mining, until all stope branch roadways allocated in all mining stages are mined and filled; and h. filling the transportation main roadway after all stope branch roadways allocated in the all mining stages have been mined and filled.

2. The skip-mining type wangeviry stope branch roadway filling and coal mining method according to claim 1, wherein, the transportation main roadway has a width of substantially 5 m to 6 m, and each of; the stope branch roadways has a width greater than or equal to 3.3 m and has a length of substantially 5 m to 150 m.

* * * * *